US009176513B2

(12) United States Patent
Al-Absi et al.

(10) Patent No.: US 9,176,513 B2
(45) Date of Patent: Nov. 3, 2015

(54) HIGH DYNAMIC RANGE EXPONENTIAL CURRENT GENERATOR WITH MOSFETS

(71) Applicant: KING FAHD UNIVERSITY OF PETROLEUM AND MINERALS, Dhahran (SA)

(72) Inventors: Munir A. Al-Absi, Dhahran (SA); Karama M. Al-Tamimi, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 115 days.

(21) Appl. No.: 14/243,741

(22) Filed: Apr. 2, 2014

(65) Prior Publication Data

US 2015/0286237 A1 Oct. 8, 2015

(51) Int. Cl.
*G05F 1/10* (2006.01)
*G05F 3/16* (2006.01)

(52) U.S. Cl.
CPC ..... *G05F 3/16* (2013.01)

(58) Field of Classification Search
CPC ..... G05F 3/262; G05F 3/242; G05F 3/205; G05F 3/247; G05F 3/245
USPC ..... 327/538, 540, 541, 543; 323/315
See application file for complete search history.

(56) References Cited

U.S. PATENT DOCUMENTS

| | | | | |
|---|---|---|---|---|
| 6,744,319 | B2 | 6/2004 | Kim | |
| 6,882,185 | B1 | 4/2005 | Walker et al. | |
| 7,180,358 | B2 | 2/2007 | Kwon et al. | |
| 7,514,980 | B2 | 4/2009 | Choi et al. | |
| 7,979,036 | B2 | 7/2011 | Zheng | |
| 8,305,134 | B2 | 11/2012 | Hirose et al. | |
| 2010/0259317 | A1* | 10/2010 | Lu et al. | 327/543 |
| 2012/0081168 | A1* | 4/2012 | Hastings | 327/346 |

* cited by examiner

*Primary Examiner* — Quan Tra
(74) *Attorney, Agent, or Firm* — Richard C. Litman

(57) ABSTRACT

The high dynamic range exponential current generator produces an output waveform (current/voltage) which is an exponential function of the input waveform (current/voltage). The exponential characteristics are obtained in BiCMOS or Bipolar technologies using the intrinsic characteristics ($I_C/V_{BE}$) of the bipolar transistors. The high dynamic range exponential current generator is biased in weak inversion region. MOSFETs biased in weak inversion region are used not to utilize the inherent exponential ($I_{DS}/V_{GS}$) relationship but to simply implement $x^2$ and $x^4$ terms using translinear loops. The term $x^4$ is realized by two cascaded squaring units. The approximation equation used is $$e^x \cong \frac{0.025 + (1 + 0.125x)^4}{0.025 + (1 - 0.125x)^4}.$$

4 Claims, 12 Drawing Sheets

HIGH DYNAMIC RANGE EXPONENTIAL CURRENT GENERATOR WITH MOSFETS

BACKGROUND OF THE INVENTION

1. Field of the Invention

The present invention relates to exponential generator circuits, and particularly to a high dynamic range exponential current generator utilizing MOSFETS operating in the weak inversion mode.

2. Description of the Related Art

An exponential function generator produces an output waveform (current/voltage) which is an exponential function of the input waveform (current/voltage). The exponential characteristics can be easily obtained in BiCMOS or Bipolar technologies using the intrinsic characteristics ($I_C/V_{BE}$) of the bipolar transistors. Though, it is not easy to realize such function in CMOS technology because of the inherent square-law or linear characteristics of MOSFETs operating in the strong inversion region. So the widely used technique to implement analog exponential function circuits using MOSFETs in strong inversion is based on pseudo-approximations. To mathematically implement the exponential function by this method, different approximations have been already introduced; Taylor series $2^{nd}$ order, Taylor series $4^{th}$ order, Pseudo exponential, Pseudo-Taylor approximation, Modified Pseudo-Taylor approximation, additional approximations have been proposed.

A MOSFET device biased in weak inversion region is a well-known approach to introduce an exponential function due to the exponential relationship between $I_{DS}$ and $V_{GS}$ of MOSFET in weak inversion regime. Referring to $I_{DS}/V_{gs}$ relationship, the drain current of MOSFET in weak inversion region is given by:

$$I_{DS} = 2n\mu_n C_{ox}\frac{W}{L}V_T^2 e^{\left(\frac{V_{gs}-V_{th}}{nU_T}\right)}$$

Although the low $V_{GS}$ voltage makes this technique efficient in low voltage applications compared with approximations that use MOSFET in strong inversion regime but, obviously, the exponential relation between $I_{DS}$ and $V_{GS}$ is not perfect because it suffers from strong temperature dependency, threshold voltage variation effect and sensitivity against process variation. Therefore, it is highly preferred to design an exponential function generator that provides accurate and stable exponential function vs. temperature variation; provides a robust and efficient design versus the supply voltage variation; utilizes current-input current-output exponential generator thereby providing higher frequencies of operation and wider dynamic ranges and extended output range with minimum linearity error.

Thus, a high dynamic range exponential current generator with MOSFETs solving the aforementioned problems is desired.

SUMMARY OF THE INVENTION

The high dynamic range exponential current generator produces an output waveform (current/voltage) which is an exponential function of the input waveform (current/voltage). The exponential characteristics are obtained in BiCMOS or Bipolar technologies using the intrinsic characteristics ($I_C/V_{BE}$) of the bipolar transistors. The high dynamic range exponential current generator is biased in weak inversion region. MOSFETs biased in weak inversion region are used not to utilize the inherent exponential ($I_{DS}/V_{GS}$) relationship but to simply implement $x^2$ and $x^4$ terms using translinear loops. The term $x^4$ is realized by two cascaded squaring units. The approximation equation used is $$e^x \cong \frac{0.025 + (1 + 0.125x)^4}{0.025 + (1 - 0.125x)^4}.$$

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 7:
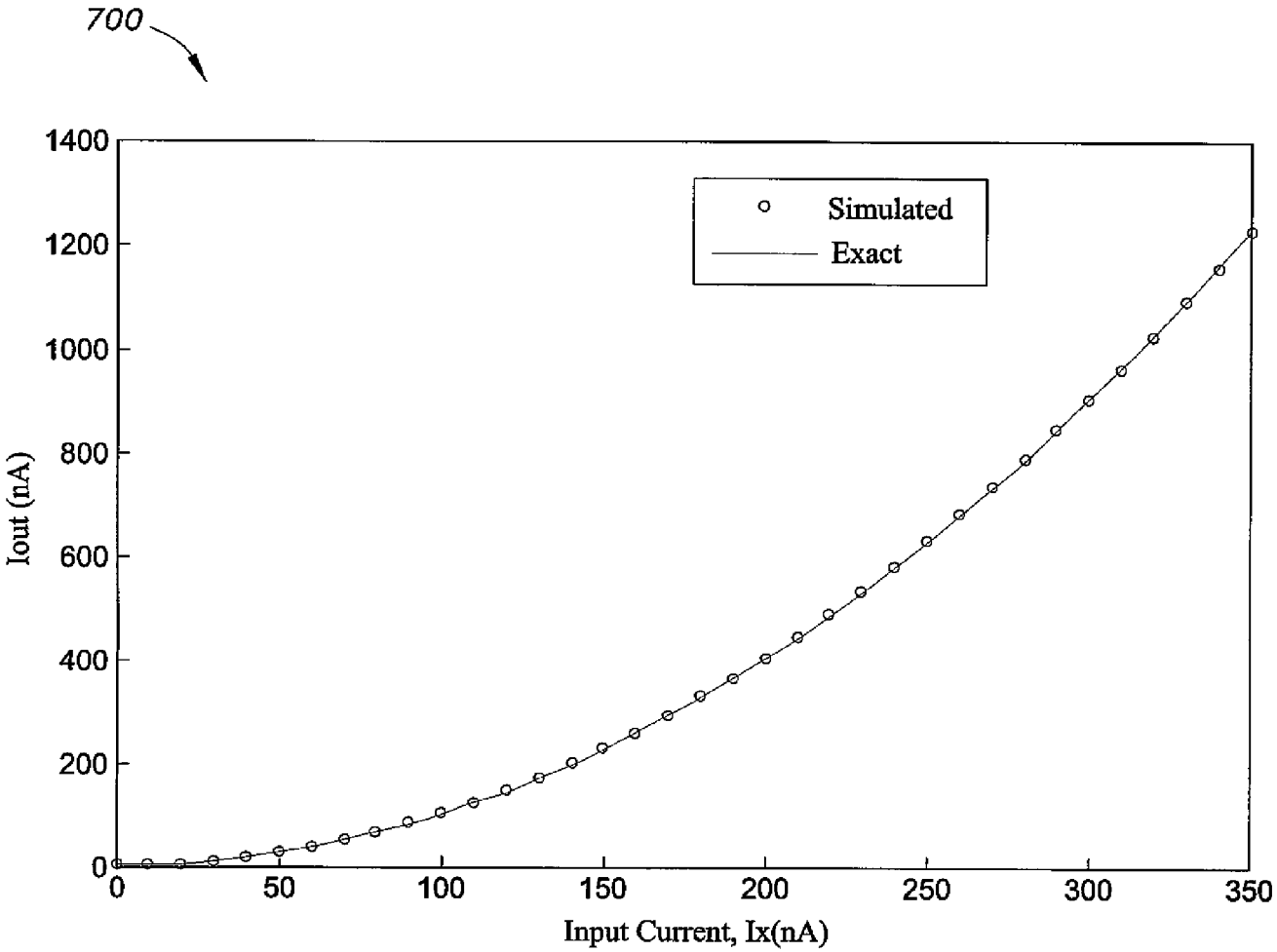
FIG. 7 is a plot showing exact vs. simulation results of the SQ block of the high dynamic range exponential current generator according to the present invention.

The high dynamic range exponential current generator produces an output waveform (current/voltage) which is an exponential function of the input waveform (current/voltage). The exponential characteristics are obtained in BiCMOS or Bipolar technologies using the intrinsic characteristics ($I_C/V_{BE}$) of the bipolar transistors. The high dynamic range exponential current generator is biased in weak inversion region. MOSFETs biased in weak inversion region are used to simply implement $x^2$ and $x^4$ terms using translinear loops. The term $x^4$ is realized by two cascaded squaring units 106. The exponential function generator approximation equation used is characterized by the relation, $$e^x \cong \frac{0.025 + (1 + 0.125x)^4}{0.025 + (1 - 0.125x)^4}, \quad (1)$$

and has a dynamic range of approximately 96 dB. Plot 700 of FIG. 7 shows exact vs. simulation results of the squaring unit 106.

Figure 2A:
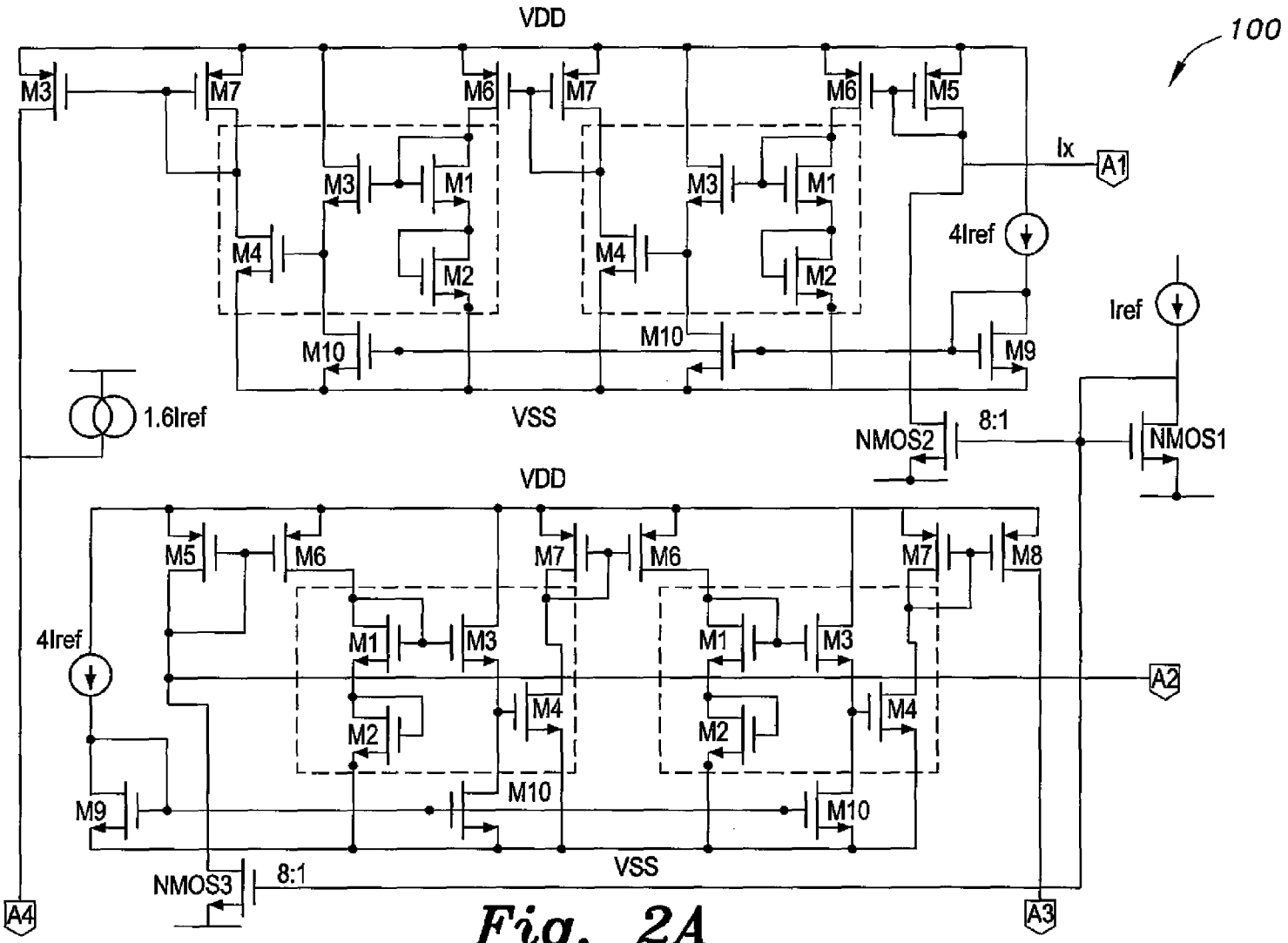
FIGS. 2A-2C is a circuit diagram of the high dynamic range exponential current generator according to the present invention.
Figure 2B:
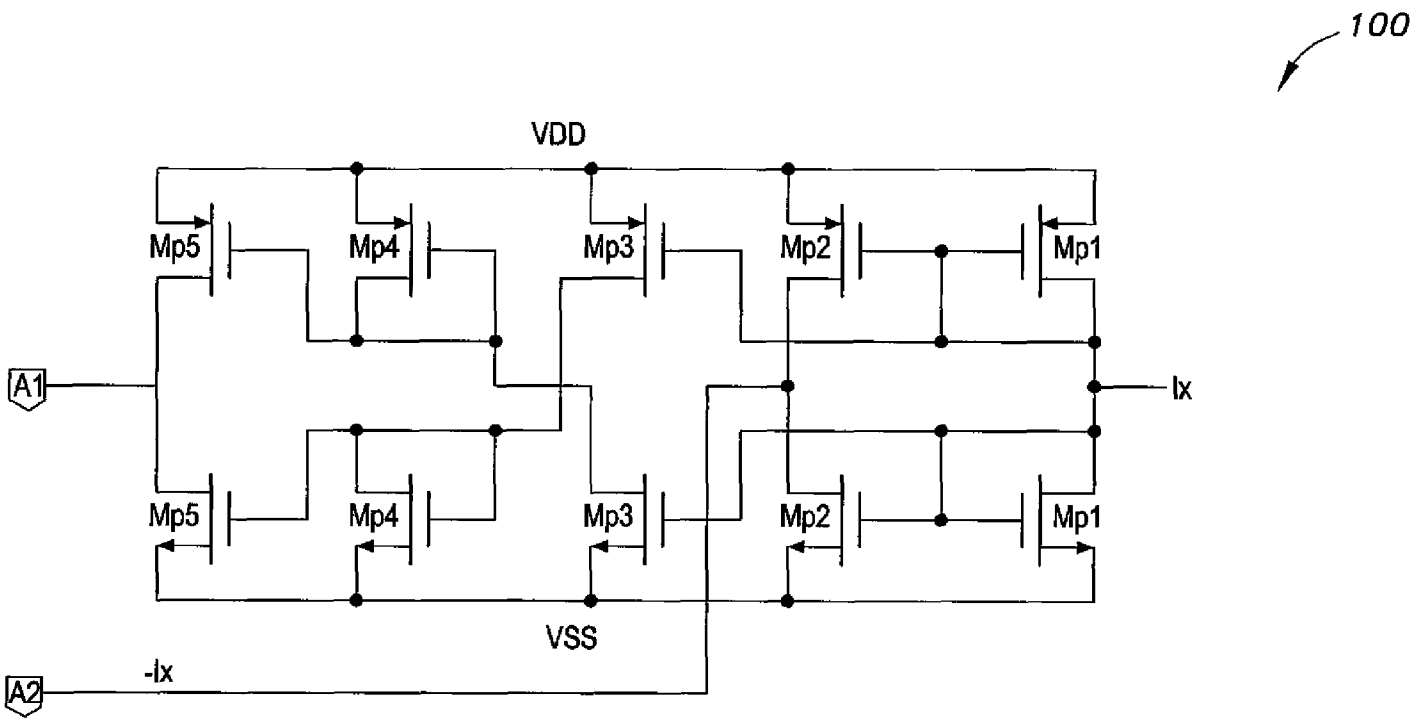
Figure 2C:
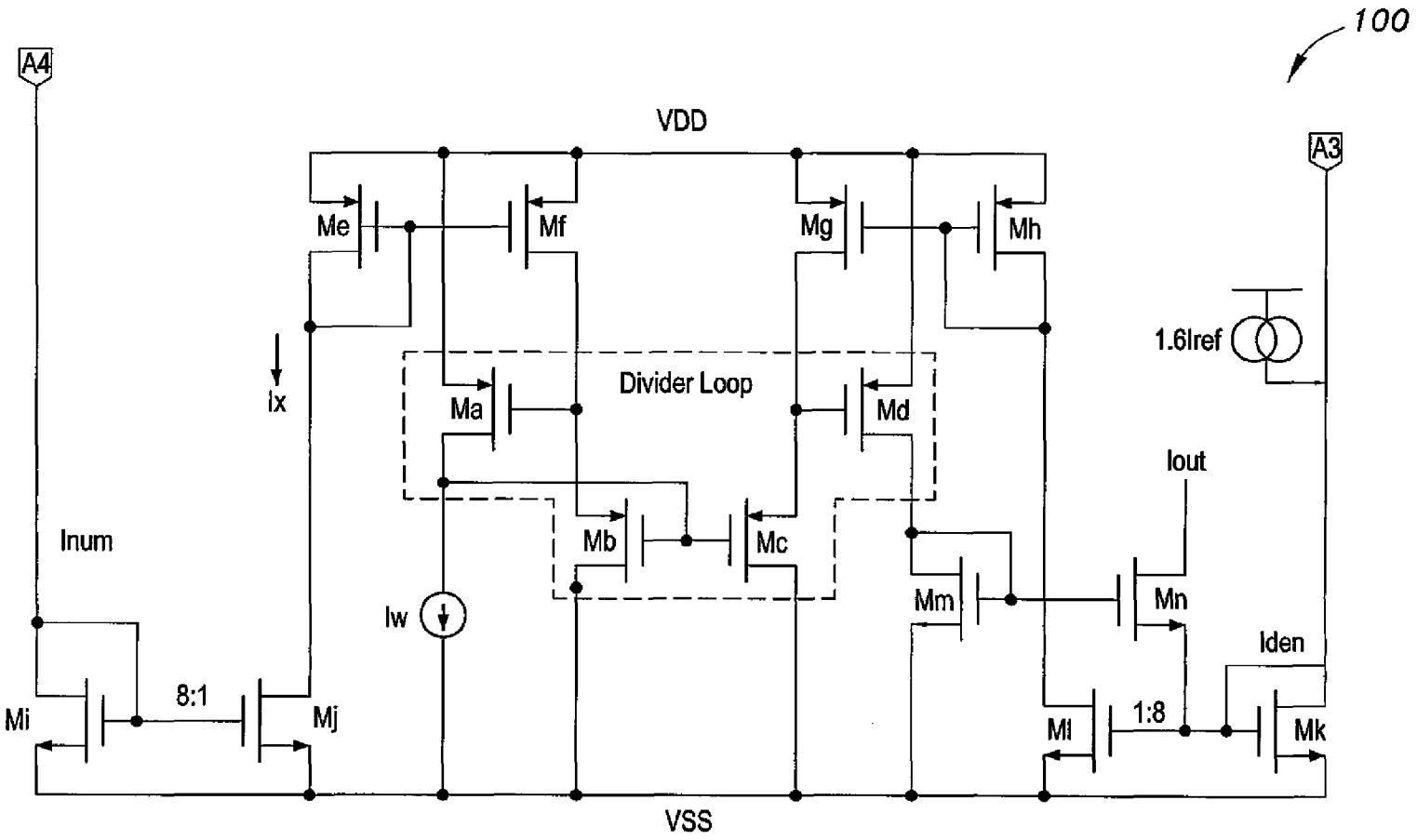

The full block diagram of the present high dynamic range exponential current generator with MOSFETs 100 is shown in FIGS. 2A-2C. The number of transistors used in the overall circuit is 65 MOSFETs without any passive elements and all of them are stacked between ±0.75V voltage-supply.

Figure 1:
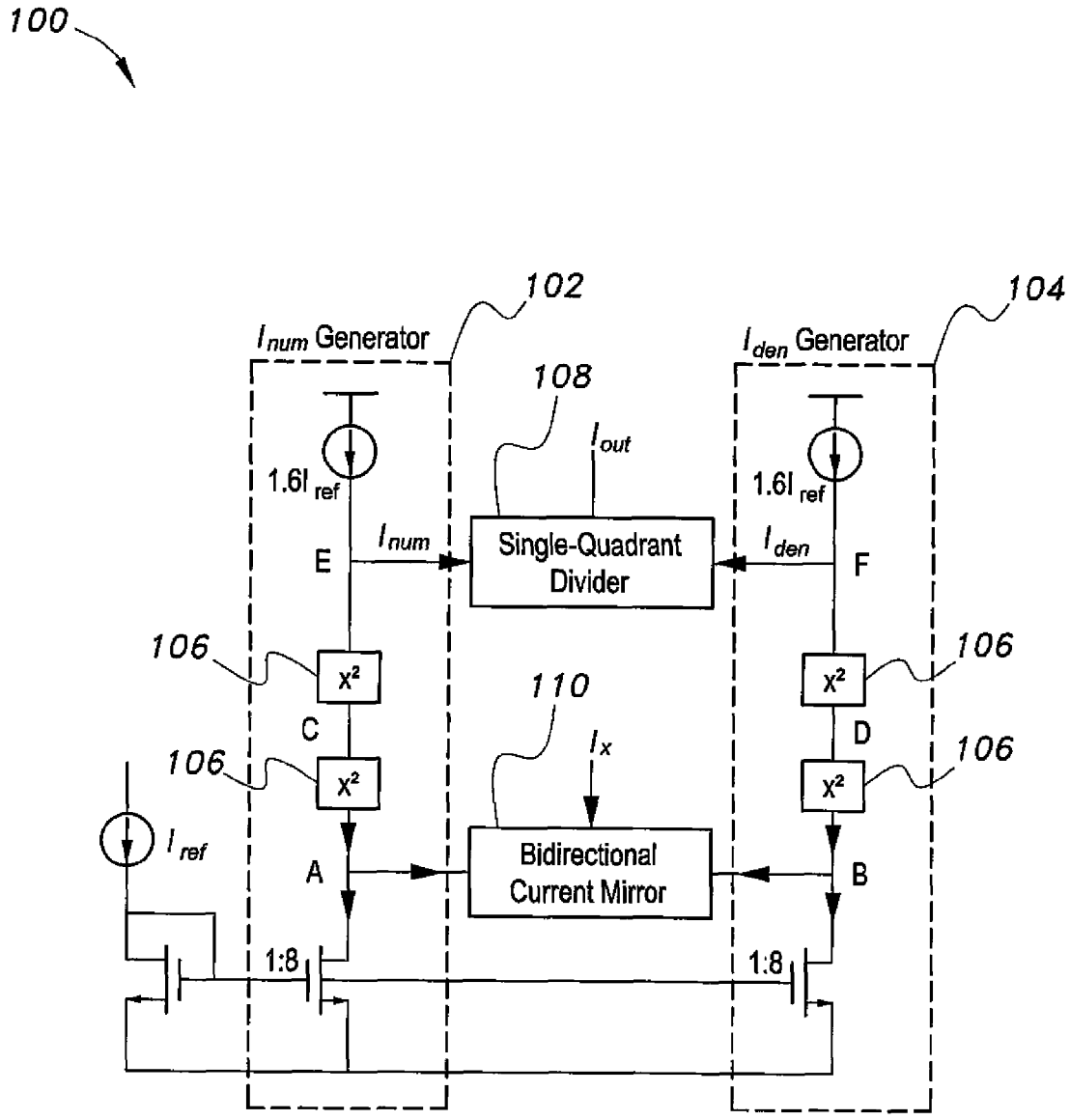
FIG. 1 is a block diagram of the high dynamic range exponential current generator according to the present invention.
Figure 3:
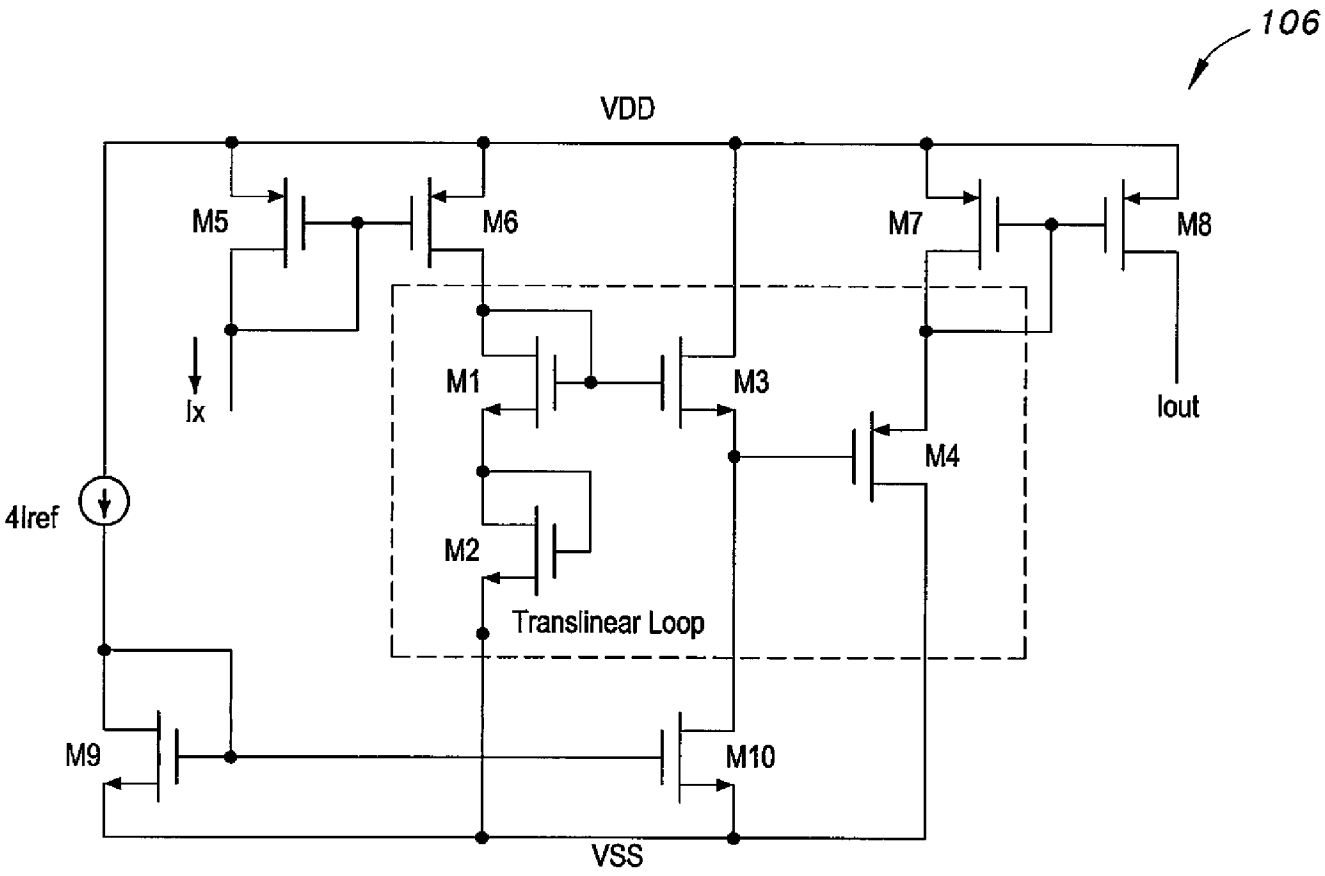
FIG. 3 is a circuit diagram of a squaring unit of the high dynamic range exponential current generator according to the present invention.

The squaring unit 106 is shown in detail in FIG. 3. The voltage supply is ±0.75V and the aspect ratios of the transistors are illustrated in Table 1. The constant currents equal to 4 $I_{ref}$ and 1.6 $I_{ref}$ can be easily provided by a proper current source and current sink of current $I_{ref}$; e.g. if the current $I_{ref}$ shown in FIG. 1 is set to be 25 nA, then the constant current 4 $I_{ref}$ flowing through M9 (shown in FIG. 3) will be 100 nA. With reference to the MOSFET circuitry of squaring unit 106, by applying Translinear Loop (TL) through transistors M1-M4 then, $$V_{gs1}+V_{gs2}=V_{gs3}+V_{gs4}, \quad (2)$$

where $V_{gs1}$, $V_{gs2}$, $V_{gs3}$ and $V_{gs4}$ are the gate-to-source voltages of M1, M2, M3 and M4 respectively. From equation (2), one obtains the following:

$$I_1I_2=I_3I_4. \quad (3)$$

Since $I_1=I_2=I_x$, $I_3=4I_{ref}$ and $I_4=I_{out}$ then the output current will be expressed as follows:

$$I_{out} = \frac{I_x^2}{4I_{ref}}. \quad (4)$$

Equation (4) represents the current-mode squaring function. Since the squaring circuit 106 is a key block in the present current-mode exponential generator 100, the simulation results have been carried out to demonstrate the validity of the theory. The corresponding maximum error is 1.5% and the circuit is stable with temperature variation. Table 1 details the aspect ratios of the squaring unit.

TABLE 1

Aspect ratios of squaring unit

| Transistor | Aspect Ratio $\frac{W(\mu m)}{L(\mu m)}$ | Ratio |
|---|---|---|
| M1, M3 | 3.5/7 | 0.5 |
| M2, M4 | 91.7/7 | 13.1 |
| M5-M10 | 7/7 | 1 |

Figure 4:
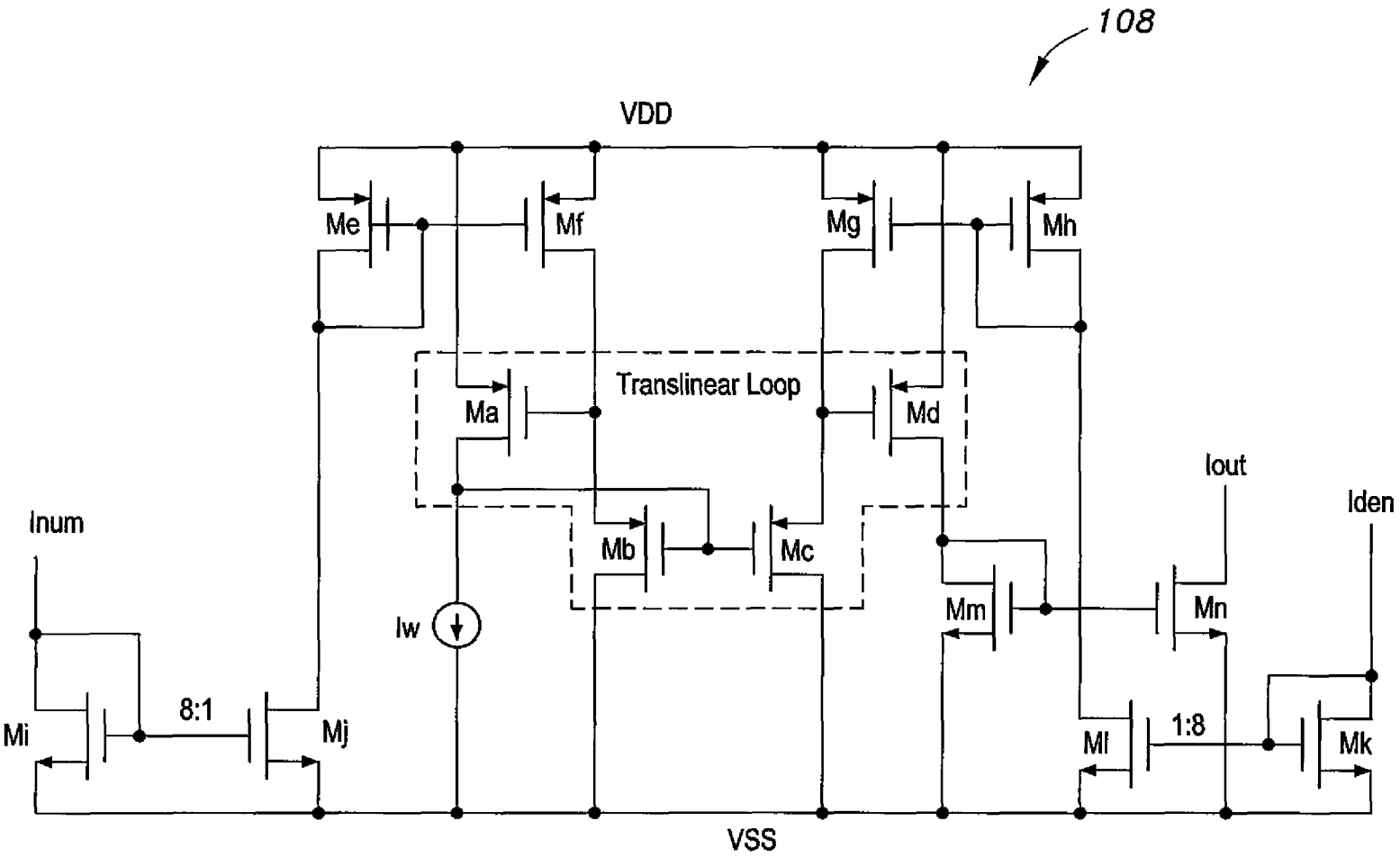
FIG. 4 is a circuit diagram of a single quadrant divider of the high dynamic range exponential current generator according to the present invention.

With respect to the current divider 108, as shown in FIG. 4, the transistors involved in dashed box Ma-Md forms a single-quadrant current divider where all transistors are operating in the sub-threshold region. Analysis of the Ma-Md loop results in:

$$V_{sga}+V_{sgb}=V_{sgc}+V_{sgd}, \quad (5)$$

$$I_aI_b=I_cI_d, \quad (6)$$

with $I_a=I_w$, $I_b=0.125\ I_{num}$, $I_c=0.125\ I_{den}$, and $I_d=I_{out}$. Then the equation (6) becomes $$I_{out,Divider} = I_w \frac{I_{num}}{I_{den}}. \quad (7)$$

The transistor ratios are shown in Table 2. The $$\left(\frac{W}{L}\right)_{j,l} = \frac{1}{8}\left(\frac{W}{L}\right)_{i,k}$$

scale down the currents $I_{num}$ and $I_{den}$ so that transistors Mb (representing the dividend quantity) and Mc (representing the divisor quantity) can absorb this amount of current and as a result the quotient amount (represented by Md) can be improved in terms of accuracy. This implies that the aspect ratios of all the transistors involved in the translinear loop must be selected to meet the anticipated dynamic range of the input and output currents. Table 2 details the transistor dimensions of the single quadrant divider circuit 108.

TABLE 2

Transistor dimensions of the single quadrant divider circuit

| Transistor | Aspect Ratio $\frac{W(\mu m)}{L(\mu m)}$ | Ratio |
|---|---|---|
| Ma, Md | 196/1.4 | 140 |
| Mb, Md | 175/1.4 | 125 |
| Me-Mh | 7/7 | 1 |
| Mi, Mk | 19.6/19.6 | 1 |
| Mj, Ml | 2.45/19.6 | 0.125 |
| Mm-Mn | 1/1 | 1 |

Figure 5:
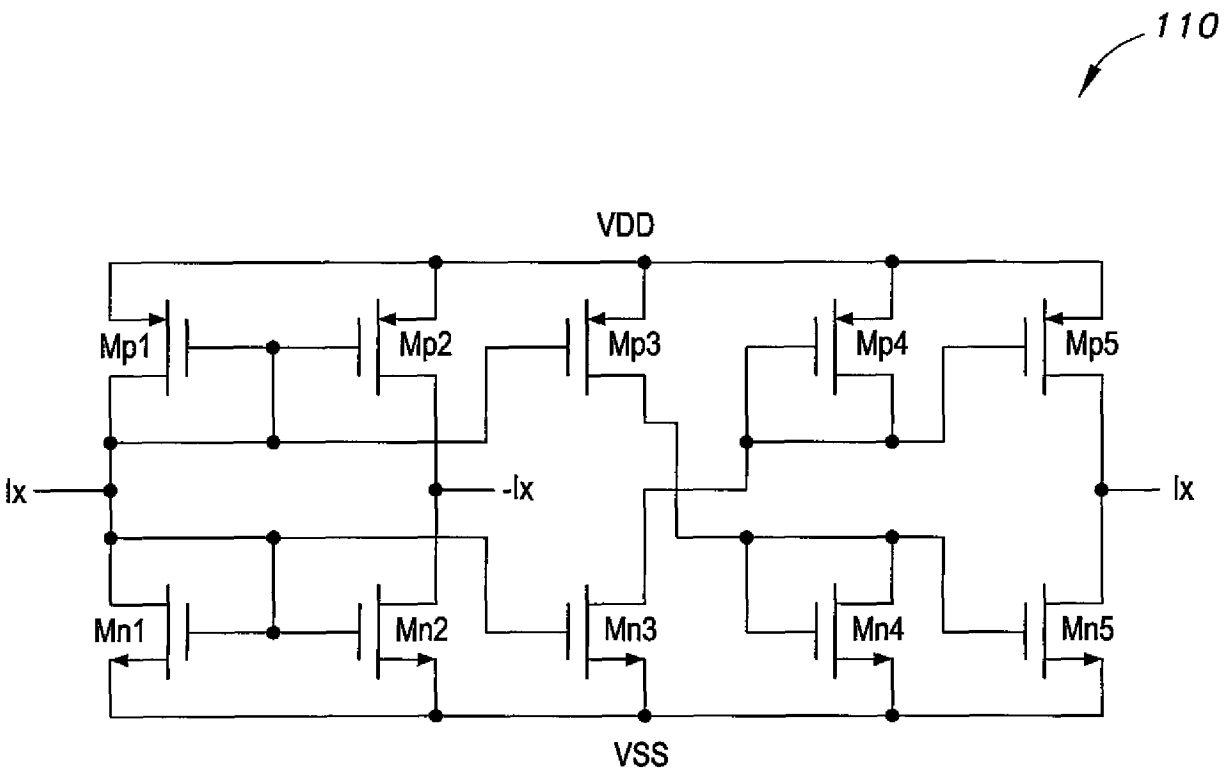
FIG. 5 is a circuit diagram of a current mirror of the high dynamic range exponential current generator according to the present invention.
Figure 6:
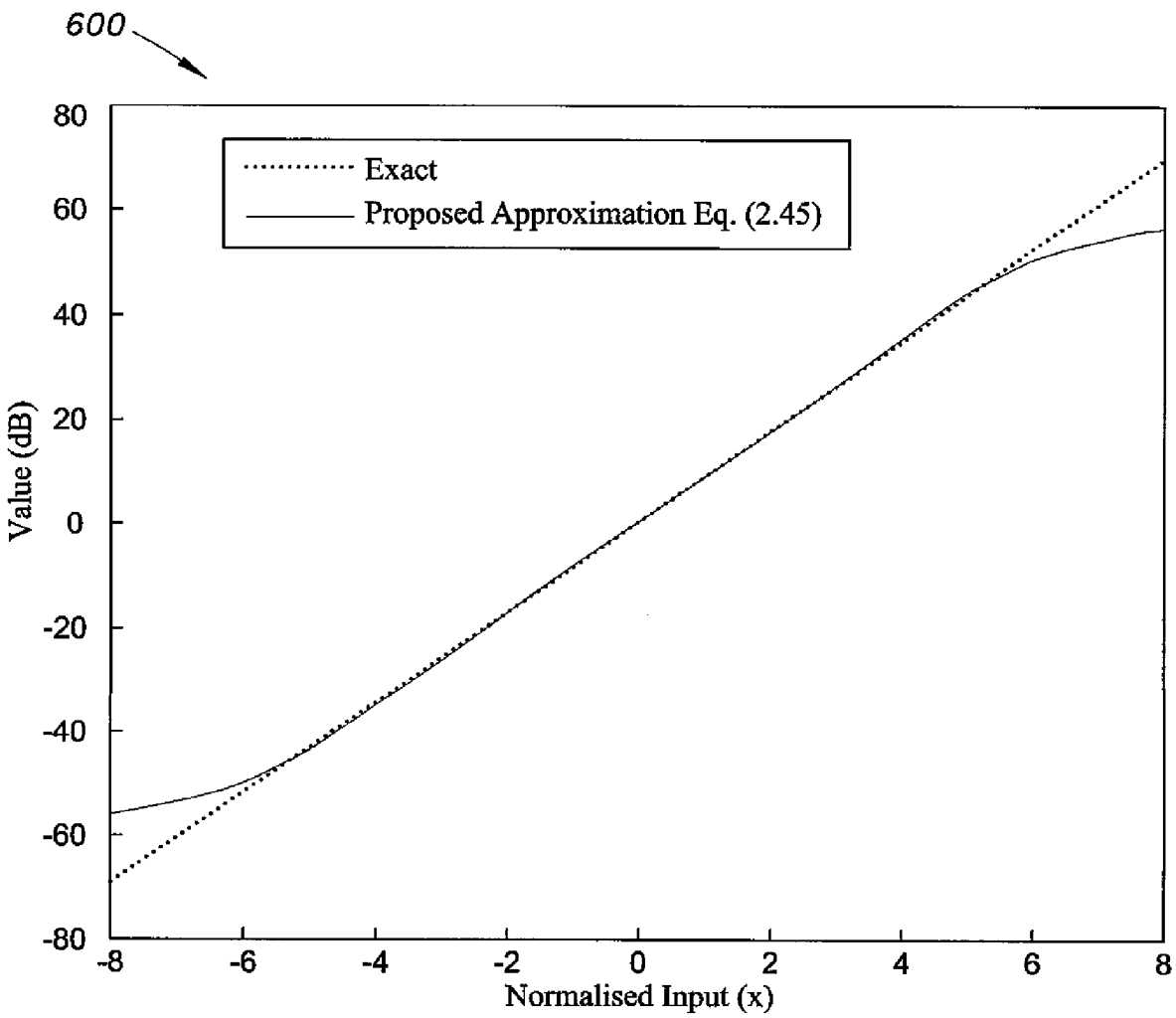
FIG. 6 is a plot showing exact vs. proposed exponential approximation according to the present invention.
Figure 8:
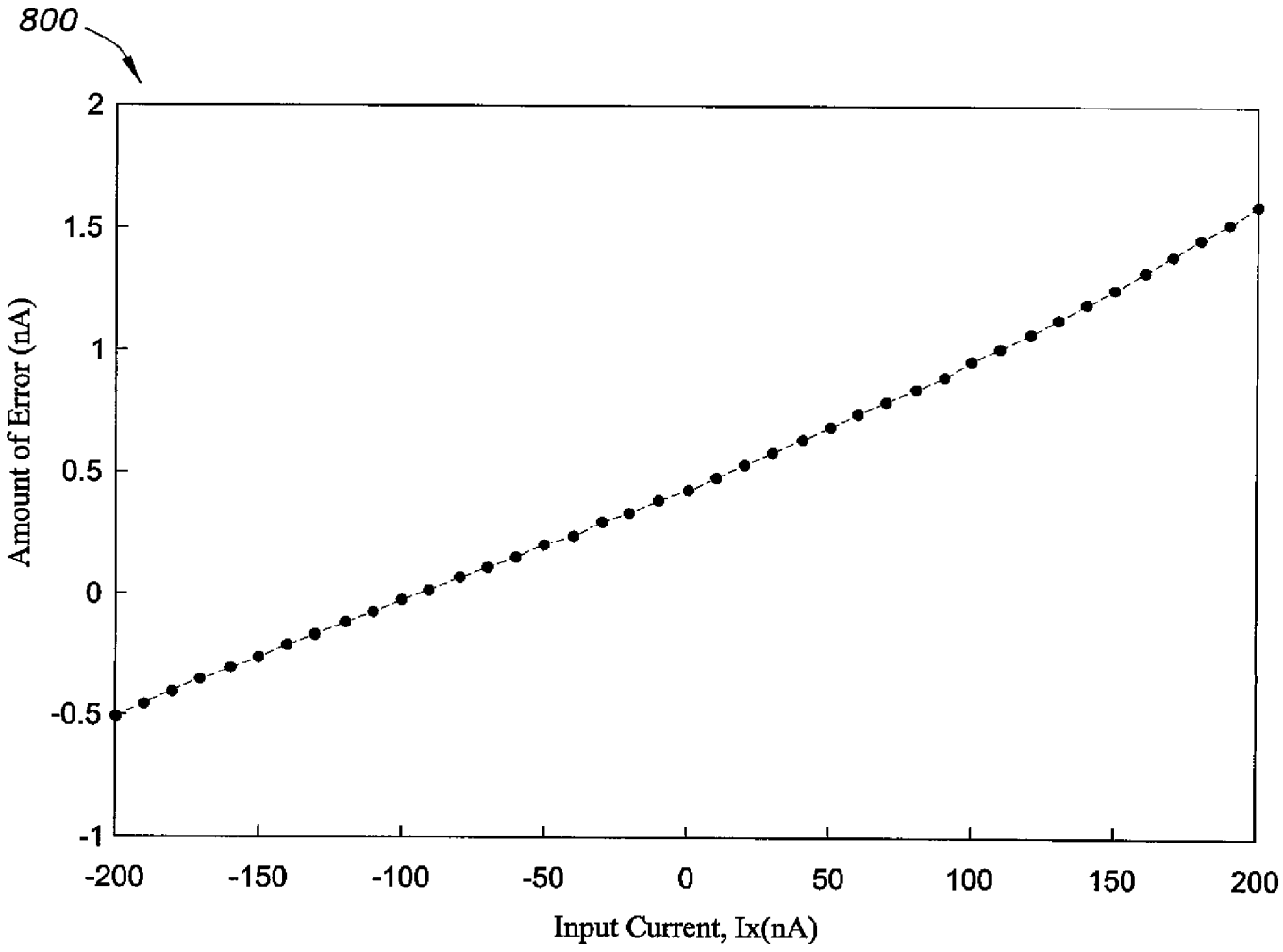
FIG. 8 is a plot showing BDCM error of the high dynamic range exponential current generator according to the present invention.

As shown in FIG. 5, the current mirror circuitry (CM) 110 has two output currents. If the input current is $I_x$ then two copies of this current can obtained at the output, $I_x$ and $-I_x$. The dimensions of CM 110 are listed in Table 3. The simulation results with ±0.75V voltage supply are shown to verify the functionality of the circuit. Plot 600 of FIG. 6 shows exact vs. the present exponential approximation. With respect to the DC transfer characteristics and transient response, the calculated error is very small, as shown in plot 800 of FIG. 8.

TABLE 3

Dimensions of CM

| Transistor | Aspect Ratio $\frac{W(\mu m)}{L(\mu m)}$ | Ratio |
|---|---|---|
| Mn1-Mn5 | 1/10 | 0.1 |
| Mp1-Mp5 | 1.7/10 | 0.17 |

With reference to the present current mode exponential generator 100 as shown in FIG. 1, there are nodes A, B, C, D, E and F. The current flows through these nodes as follows:

$$I_A = 8I_{ref} + I_x = 8I_{ref}\left(1 + 0.125\frac{I_x}{I_{ref}}\right) \tag{8}$$

$$I_B = 8I_{ref} - I_x = 8I_{ref}\left(1 - 0.125\frac{I_x}{I_{ref}}\right) \tag{9}$$

$$I_C = \frac{(8I_{ref})^2\left(1 + 0.125\frac{I_x}{I_{ref}}\right)^2}{4I_{ref}} \tag{10}$$

$$I_D = \frac{(8I_{ref})^2\left(1 - 0.125\frac{I_x}{I_{ref}}\right)^2}{4I_{ref}} \tag{11}$$

$$I_E = \frac{(8I_{ref})^4\left(1 + 0.125\frac{I_x}{I_{ref}}\right)^4}{(4I_{ref})^3} = 64I_{ref}\left(1 + 0.125\frac{I_x}{I_{ref}}\right)^4 \tag{12}$$

$$I_F = \frac{(8I_{ref})^4\left(1 - 0.125\frac{I_x}{I_{ref}}\right)^4}{(4I_{ref})^3} = 64I_{ref}\left(1 - 0.125\frac{I_x}{I_{ref}}\right)^4 \tag{13}$$

$$I_{num} = 1.6I_{ref} + 64I_{ref}\left(1 + 0.125\frac{I_x}{I_{ref}}\right)^4 = 64I_{ref}\left[0.025 + \left(1 + 0.125\frac{I_x}{I_{ref}}\right)^4\right] \tag{14}$$

$$I_{den} = 1.6I_{ref} + 64I_{ref}\left(1 - 0.125\frac{I_x}{I_{ref}}\right)^4 = 64I_{ref}\left[0.025 + \left(1 - 0.125\frac{I_x}{I_{ref}}\right)^4\right] \tag{15}$$

By recall of the equations, the output current of the present EXPFG will be $$I_{out} = I_w\frac{I_{num}}{I_{den}} = I_w\left\{\frac{\left[0.025 + \left(1 + 0.125\frac{I_x}{I_{ref}}\right)^4\right]}{\left[0.025 + \left(1 - 0.125\frac{I_x}{I_{ref}}\right)^4\right]}\right\} \cong I_w e^{\left(\frac{I_x}{I_{ref}}\right)} \text{ and,} \tag{16}$$

$$I_{out} = I_w e^{\left(\frac{I_x}{I_{ref}}\right)}, \tag{17}$$

where $I_{out}$ is the output current, $I_x$ is the input ac signal, $I_{ref}$ is a constant current and $I_w$ is a DC component which can be used to scale the output signal. From equation (17), it is clear that the exponential current-mode generator can be realized and its output current can be adjusted by $I_w$. The full circuit of the present current-mode exponential function generator (EXPFG) 100 is shown in FIGS. 2A-2C.

Referring again to EXPFG 100 of FIG. 1, if the current mirror 1.6 $I_{ref}$ is not exact (i.e. it is equal to 1.6 $I_{ref}$+$\Delta I_{ref}$), then equations (14) to (16) can be reevaluated and the output current is expressed as:

$$I_{out} = I_w\frac{I_{num}}{I_{den}} = I_w\left\{\frac{\left[k + \left(1 + 0.125\frac{I_x}{I_{ref}}\right)^4\right]}{\left[k + \left(1 - 0.125\frac{I_x}{I_{ref}}\right)^4\right]}\right\}, \tag{18}$$

where $$k = 0.025 + \frac{\Delta I_{ref}}{64I_{den}}.$$

Figure 9:
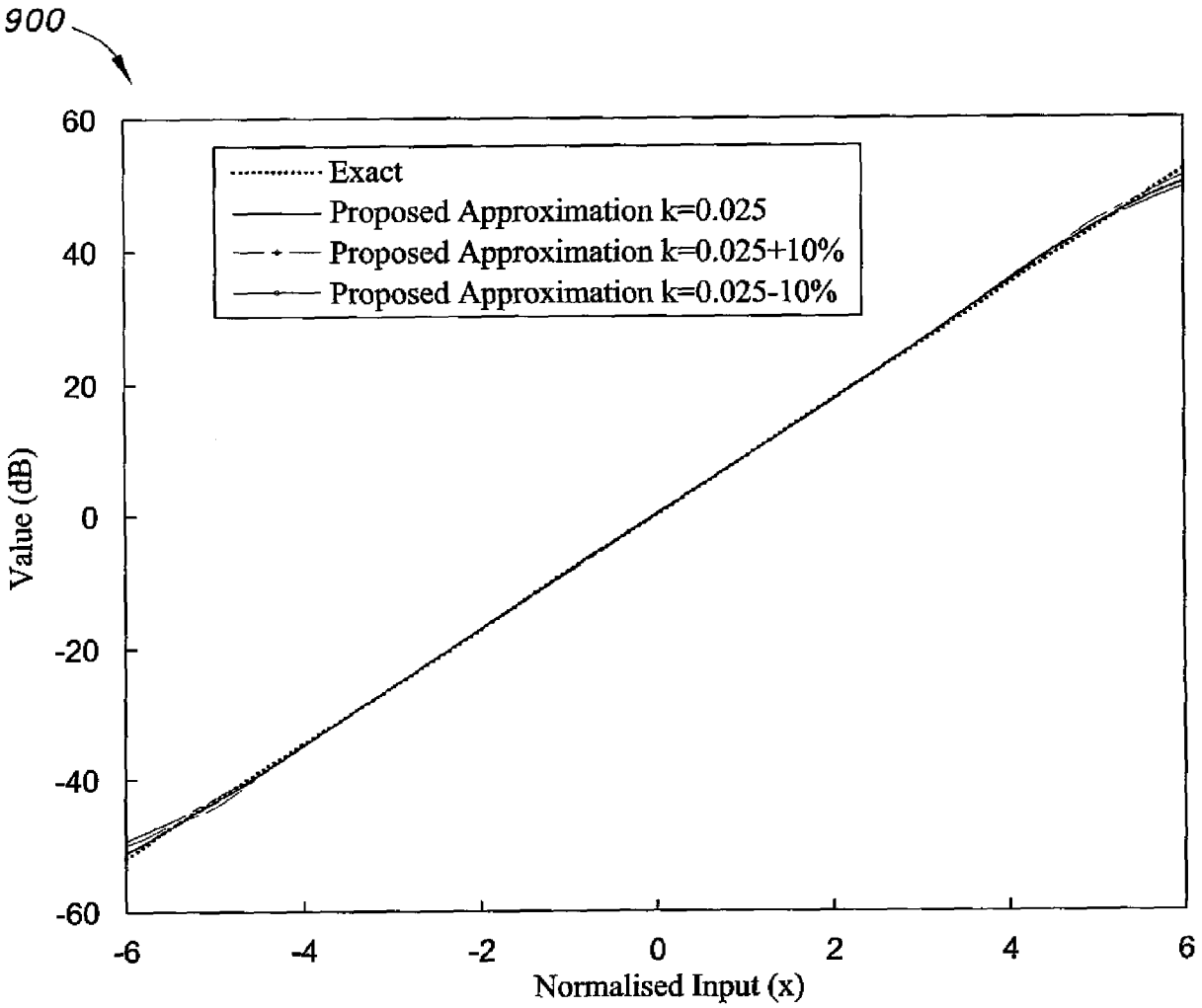
FIG. 9 is a plot showing effect of mismatch in the current mirror of the high dynamic range exponential current generator according to the present invention.

Assuming that there is ±10% deviation from the exact value (0.025), the results shown in plot 900 of FIG. 9 demonstrate that the deviation is not significant.

Figure 10:
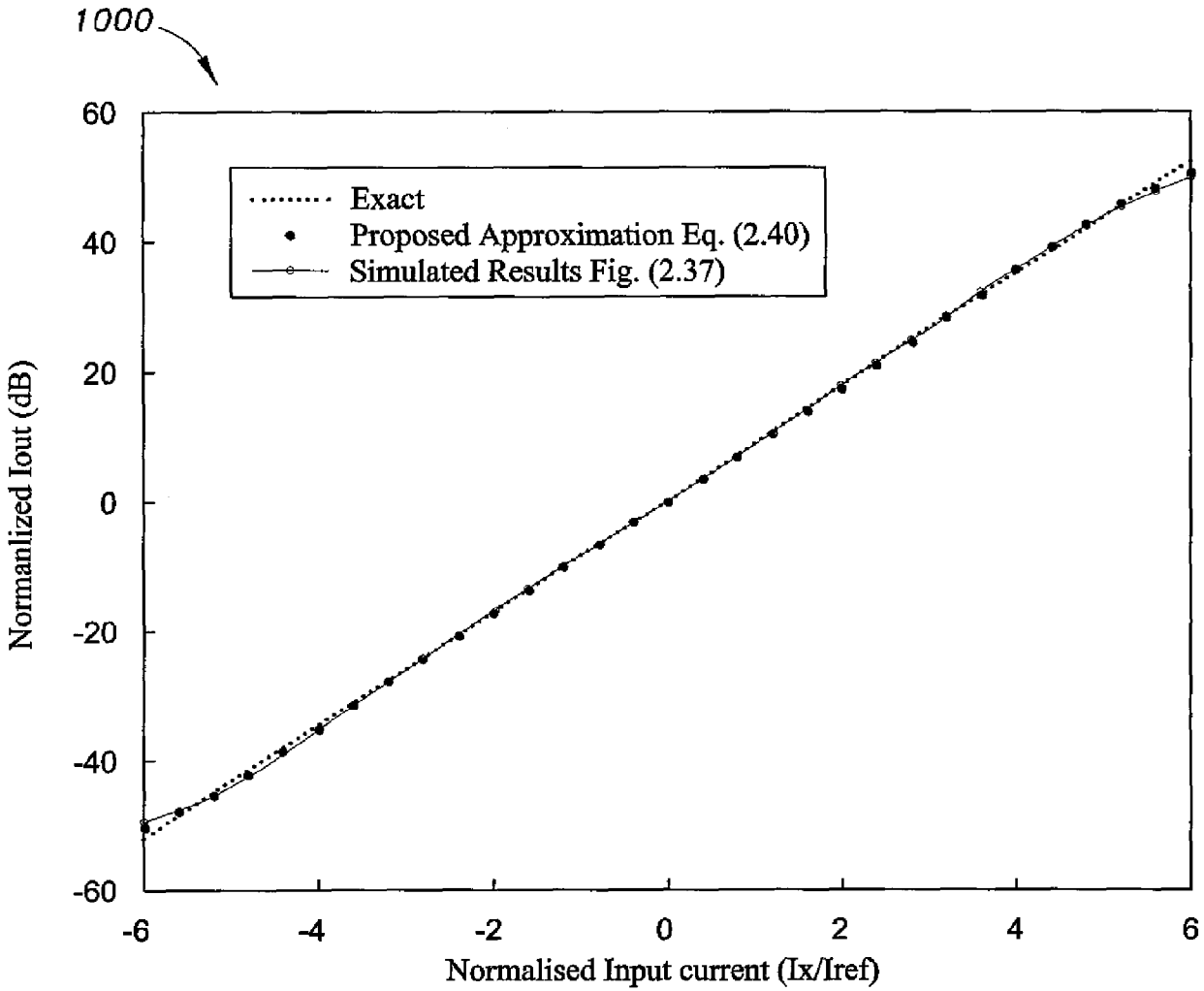
FIG. 10 is a plot showing linear-in-dB characteristics of the high dynamic range exponential current generator according to the present invention.

The EXPFG Circuit 100 shown in detail in FIGS. 2A-2C is used to implement the present function and is verified by simulation in 0.35 μm CMOS process technology with supply voltage ±0.75V. The threshold voltage of PMOS and NMOS is 0.833V and 0.572V in this process technology. The Tanner simulation result is illustrated in plot 1000 of FIG. 10 where $I_{ref}$ equals to 25 nA. Thus the x-axis, 150 nA≤$I_x$≤150 nA, can be normalized as −6≤x≤6 for comparison purposes. The curve of the present function is very close to the ideal exponential function, $$I_w e^{\left(\frac{I_x}{25\ nA}\right)},$$

with a high output dynamic range, nearly 96 dB. The error between the present function and the ideal exponential function, $$I_w e^{\left(\frac{I_x}{25\ nA}\right)},$$

is limited to ±0.5 dB when −137.5 nA≤$I_x$≤137.5 nA.

The simulation of transient response has been carried out with sinusoidal input signal of frequency 5 kHz. With respect to the results of normalized output current $I_{out}$ (dB) at −25° C., +25° C. and +75° C., as expected the input\output characteristics are roughly stable with temperature variation. The linearity error remains less than ±1.5 dB for the full scale of the input current range. The maximum deviation of the output current was about ±1.27 dB and is occurred for the normalized value $$\frac{I_x}{I_{ref}} = 5.25.$$

It is to be understood that the present invention is not limited to the embodiments described above, but encompasses any and all embodiments within the scope of the following claims.

We claim:

1. A high dynamic range exponential current generator with MOSFETs, comprising:

a numerator current generator;

first and second numerator current generator squaring circuits connected in-line within the numerator current generator;

a denominator current generator;

first and second denominator current generator squaring circuits connected in-line within the denominator current generator;

a single quadrant divider circuit connected between output of the first numerator current generator squaring circuit and output of the first denominator current generator squaring circuit;

a bidirectional current mirror circuit connected between output of the second numerator current generator squaring circuit and output of the second denominator current generator squaring circuit;

numerator current generator and denominator current generator being biased in a weak inversion region that provides an approximation characterized by a relation, $$e^x \cong \frac{0.025 + (1 + 0.125x)^4}{0.025 + (1 - 0.125x)^4};$$

and wherein all components of the exponential current generator are MOSFETs.

2. The high dynamic range exponential current generator with MOSFETs according to claim 1, wherein each of the squaring circuits further comprises a squaring circuit translinear loop consisting of first, second, third, and fourth squaring circuit translinear loop transistors, aspect ratio of first and third squaring circuit translinear loop transistors being approximately 0.5, aspect ratio of second and fourth squaring circuit translinear loop transistors being approximately 13.1, aspect ratio of non-translinear loop portion of the squaring circuit being approximately 1.

3. The high dynamic range exponential current generator with MOSFETs according to claim 2, wherein the single quadrant divider circuit further comprises:

a single quadrant divider circuit translinear loop consisting of first, second, third, and fourth single quadrant divider circuit translinear loop transistors, aspect ratio of first and fourth single quadrant divider circuit translinear loop transistors being approximately 140, aspect ratio of second and fourth single quadrant divider circuit translinear loop transistors being approximately 125, aspect ratio of non-translinear loop portion of the single quadrant divider circuit being approximately 1;

first, second, third and fourth VDD rail connected transistors having an aspect ratio of 1;

a VSS rail connected numerator current input following transistor of the single quadrant divider circuit;

a VSS rail connected denominator current input following transistor of the single quadrant divider circuit;

aspect ratio of the VSS rail connected numerator current input following transistor of the single quadrant divider circuit/VSS rail connected denominator current input following transistor of the single quadrant divider circuit being approximately 0.125;

a numerator current input transistor;

a denominator current input transistor;

aspect ratio of the numerator current input transistor/denominator current input transistor being approximately 1; and first and second single quadrant divider output current transistors having their gates connected together, drain of the first single quadrant divider output current transistor having its drain connected to drain of the fourth single quadrant divider translinear loop transistor, the current output being taken from drain of the second single quadrant divider output current transistor, aspect ratio of the first/second single quadrant divider output current transistors being approximately 1.

4. The high dynamic range exponential current generator with MOSFETs according to claim 3, wherein the bidirectional current mirror circuit further comprises:

VDD rail connected transistors each having an aspect ratio of approximately 0.1; and VSS rail connected transistors each having an aspect ratio of approximately 0.17.

* * * * *